US007069682B2

(12) United States Patent
Gatt et al.

(10) Patent No.: US 7,069,682 B2
(45) Date of Patent: Jul. 4, 2006

(54) QUICK CHANGE PICTURE FRAME

(75) Inventors: Raymond M. Gatt, 1466 Spring Hill Dr., Hummelstown, PA (US) 17036; Mark J. Potok, Mechanicsburg, PA (US)

(73) Assignee: Raymond M. Gatt, Hummelstown, PA (US)

( * ) Notice: Subject to any disclaimer, the term of this patent is extended or adjusted under 35 U.S.C. 154(b) by 0 days.

(21) Appl. No.: 10/670,974

(22) Filed: Sep. 25, 2003

(65) Prior Publication Data

US 2004/0111944 A1 Jun. 17, 2004

Related U.S. Application Data

(60) Provisional application No. 60/414,111, filed on Sep. 27, 2002.

(51) Int. Cl.
*A47G 1/06* (2006.01)

(52) U.S. Cl. ..... 40/793; 40/700; 40/768; 40/777

(58) Field of Classification Search ..... 40/781, 40/792, 793, 700, 745, 757, 768, 777
See application file for complete search history.

(56) References Cited

U.S. PATENT DOCUMENTS

| | | | | | |
|---|---|---|---|---|---|
| 2,259,211 | A | * | 10/1941 | Morgan | 40/536 |
| 3,411,226 | A | * | 11/1968 | Ericsson | 40/655 |
| 3,594,939 | A | * | 7/1971 | Parker | 40/790 |
| 3,665,628 | A | * | 5/1972 | Dammond | 40/792 |
| 3,946,511 | A | | 3/1976 | Wiener | |
| 3,952,437 | A | | 4/1976 | Mitchell | |
| 3,981,091 | A | | 9/1976 | Wiener | |
| 4,055,910 | A | | 11/1977 | Schmidt | |
| 4,063,378 | A | | 12/1977 | Burke | |
| 4,176,481 | A | | 12/1979 | Sawyer | |
| 4,177,590 | A | | 12/1979 | Tushner et al. | |
| 4,187,630 | A | | 2/1980 | Giulie et al. | |
| 4,271,619 | A | | 6/1981 | Schmidt | |
| 4,466,206 | A | | 8/1984 | Meadows | |
| 4,583,309 | A | * | 4/1986 | Kane et al. | 40/711 |
| 4,949,483 | A | * | 8/1990 | Dobson et al. | 40/740 |
| 4,991,328 | A | * | 2/1991 | Rousseau et al. | 40/780 |
| 5,012,600 | A | * | 5/1991 | Wang | 40/737 |
| 5,012,601 | A | | 5/1991 | Garland et al. | |
| 5,018,291 | A | * | 5/1991 | Pasquale et al. | 40/584 |
| 5,195,263 | A | | 3/1993 | Huang | |
| 5,222,315 | A | | 6/1993 | Lovison | |
| 5,243,777 | A | | 9/1993 | Dedlow | |
| 5,253,439 | A | | 10/1993 | Shanok et al. | |
| 5,353,536 | A | * | 10/1994 | Erber et al. | 40/606.1 |
| 5,419,063 | A | * | 5/1995 | Lane | 40/657 |
| 5,596,829 | A | | 1/1997 | Komamura | |
| 5,713,148 | A | | 2/1998 | Lovison | |
| 6,298,593 | B1 | | 10/2001 | Vilims et al. | |
| 6,354,031 | B1 | * | 3/2002 | Meur | 40/781 |
| 6,574,896 | B1 | * | 6/2003 | Howell | 40/737 |
| 6,792,710 | B1 | * | 9/2004 | Whitlow et al. | 40/768 |
| 2003/0226302 | A1 | * | 12/2003 | Flodin et al. | 40/781 |

* cited by examiner

*Primary Examiner*—Gary C. Hoge
(74) *Attorney, Agent, or Firm*—McNees Wallace & Nurick LLC

(57) ABSTRACT

The subject matter of the invention under consideration is directed to picture frames that can be quickly and safely assembled, installed, and disassembled to display artwork. The picture frame has a frame member and backing that are adapted for safe, easy and removable assembly using removable attachment means, and are designed for safe use by children, elderly, and disabled adults without the need for adult assistance or supervision.

3 Claims, 5 Drawing Sheets

QUICK CHANGE PICTURE FRAME

CROSS-REFERENCE TO RELATED APPLICATIONS

This application claims the benefit of U.S. Provisional Patent Application No. 60/414,111, filed Sep. 27, 2002.

FIELD OF THE INVENTION

The subject matter of the invention under consideration is directed to picture frame, and particularly to picture frames that can be easily assembled and installed to securely and removably retain planar artwork such as photographs, drawings, posters, and the like.

BACKGROUND OF THE INVENTION

A wide variety of picture frames exist. The essential elements of most known picture frames include a frame, a transparent member, and a backing mounted to the frame to retain the artwork under the transparent member and to facilitate upright display of the framed artwork. The backing is typically a heavy cardboard, and typically includes a hinged leg for upright display of the framed artwork, such as on a tabletop. The backing or frame also commonly includes wall mounting means such as a paper tab, hole, bracket, or wire for mounting over a nail driven into a wall. Such wall mounting means do not provide secure mounting because the attachment supports the frame at only a single point (i.e. at the nail location), allowing the picture to sway, or worse to become dislodged and fall to the floor.

Moreover, known picture frames are not designed for easy disassembly, such as to change the artwork. The backing is commonly held in place by flat metal tabs driven into the frame. The tabs vary in quality of materials and installation, and are often contain sharp edges that can cut the user, the backing, or the artwork during assembly, disassembly or re-assembly of the framed artwork. The tabs are designed only to survive a few picture changes, and frequently break off or split the frame material, rendering the assembly useless. Moreover, the glass in known picture frames presents a laceration hazard during assembly and use. Additionally, the need to carefully and precisely insert layers of material under the transparent member (such as matting and the artwork) further complicates assembly of known picture frames. Even if a user successfully navigates these hazards once, the hazards are present on every subsequent change of artwork. Known picture frames are simply not designed for easy and frequent change of the displayed artwork.

For all these reasons, known picture frames are not suitable for use by children, elderly, or handicapped persons. A continuing need exists for a picture frame that can be securely mounted to a vertical (or horizontal) surface, that can be safely and repeatedly assembled and disassembled by children, adults, elderly, and handicapped persons to easily and quickly alter the displayed artwork.

SUMMARY OF THE INVENTION

The present invention provides a picture frame assembly that is easy to assemble, easy to use, and that can be securely mounted to vertical or horizontal surfaces.

A significant advantage of the invention is that, once mounted on a surface, it is secure and can be easily used by children to display and change artwork without the need for adult assistance.

Another advantage is that the use of plexiglass rather than glass for the transparent member also improves safety over existing frames, and makes the frame suitable for use by physically challenged persons, including handicapped and elderly persons.

Yet another advantage is the incorporation of matting into the frame, which creates professional-looking results despite the child-simple assembly and versatility of the picture frame apparatus and method.

Still another advantage is that the invention provides a picture frame assembly having a frame member having a front surface and a rear surface separated by a perimeter edge, the frame member adapted to receive and retain a transparent member. The frame member is adapted for removable attachment to a backing member having a display surface and a rear surface separated by a side edge, the rear surface having mounting means for mounting on a mounting surface. A variety of attachment means, and combinations thereof, are disclosed herein for removably attaching the front member and the backing member.

The invention also provides a method of displaying artwork, the method comprised of the steps of providing a mounting surface, providing artwork, providing a picture frame assembly comprised of: a frame member having a front surface and a rear surface divided by a perimeter edge, the frame member adapted to receive and retain a transparent member; a backing member having a display surface and a rear surface separated by a side edge, the rear surface having mounting means for mounting on a mounting surface; and attachment means for removably attaching the front member and the backing member. The method further comprises the steps of mounting the backing member to a mounting surface, attaching the artwork to the display surface, and attaching the frame member to the backing member to yield a framed, mounted picture frame assembly Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
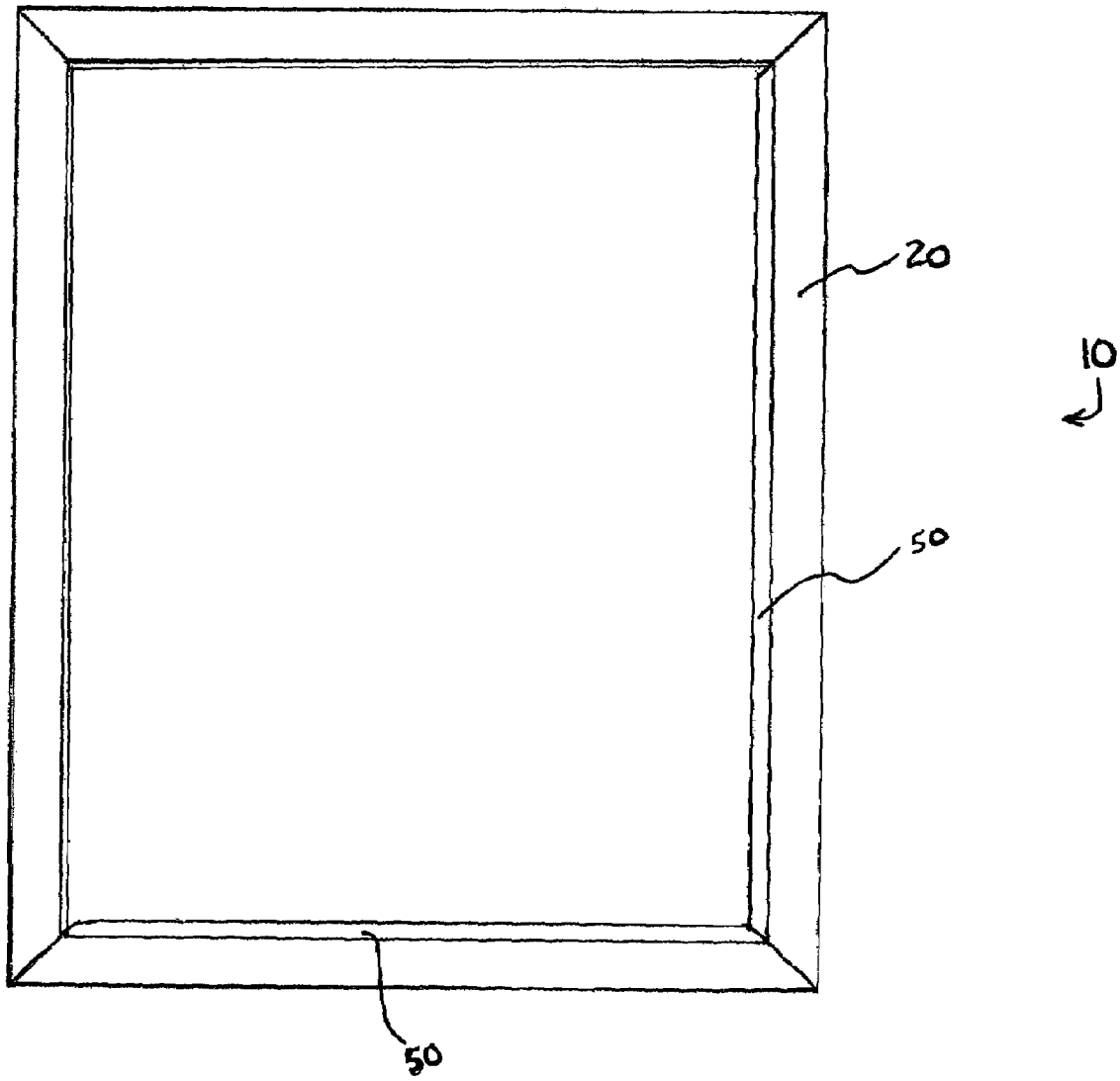
FIG. 1 is a rear view of the frame member of a first embodiment of the present invention.

This application incorporates U.S. Provisional Patent Application No. 60/414,111 herein by reference. As illustrated in FIGS. 1–7, the picture frame assembly 10 is comprised of a frame member 20 and a backing member 30. The frame member 20 has a front surface 22 and a rear surface 24 separated by a perimeter edge 26, and is adapted to securely receive and retain a transparent member 40 using means known to those skilled in the art of framing. By way of non-limiting example, exemplary transparent member receiving and retaining means include grooves, slots, tabs, adhesives, and frictional fitting. The transparent member may be any transparent rigid or semi-rigid material, but is preferably glass, plexiglass, plastic, vinyl, acrylics, polymers, or safety glass.

As further described herein, the frame member 20 further includes attachment means 50 for removably engaging the backing member 30. The attachment means are of the type that provide for secure yet removable attachment of the frame member 20 to the backing member 40. Preferably selected from the group consisting of protruding edges, spring retainers, clips, spring loaded ball devices, magnets, hook and loop fasteners, and combinations thereof.

Preferably, the picture frame assembly 10 further includes matting 42. The matting 42 may be adhered to the transparent member 40, such as by transparent adhesive or electrostatic force, may be painted or stenciled onto the transparent member 40. Alternatively, the matting 42 may be a separate planar sheet that can simply be removably positioned under the transparent member 40 and over the displayed artwork 44.

Figure 2:
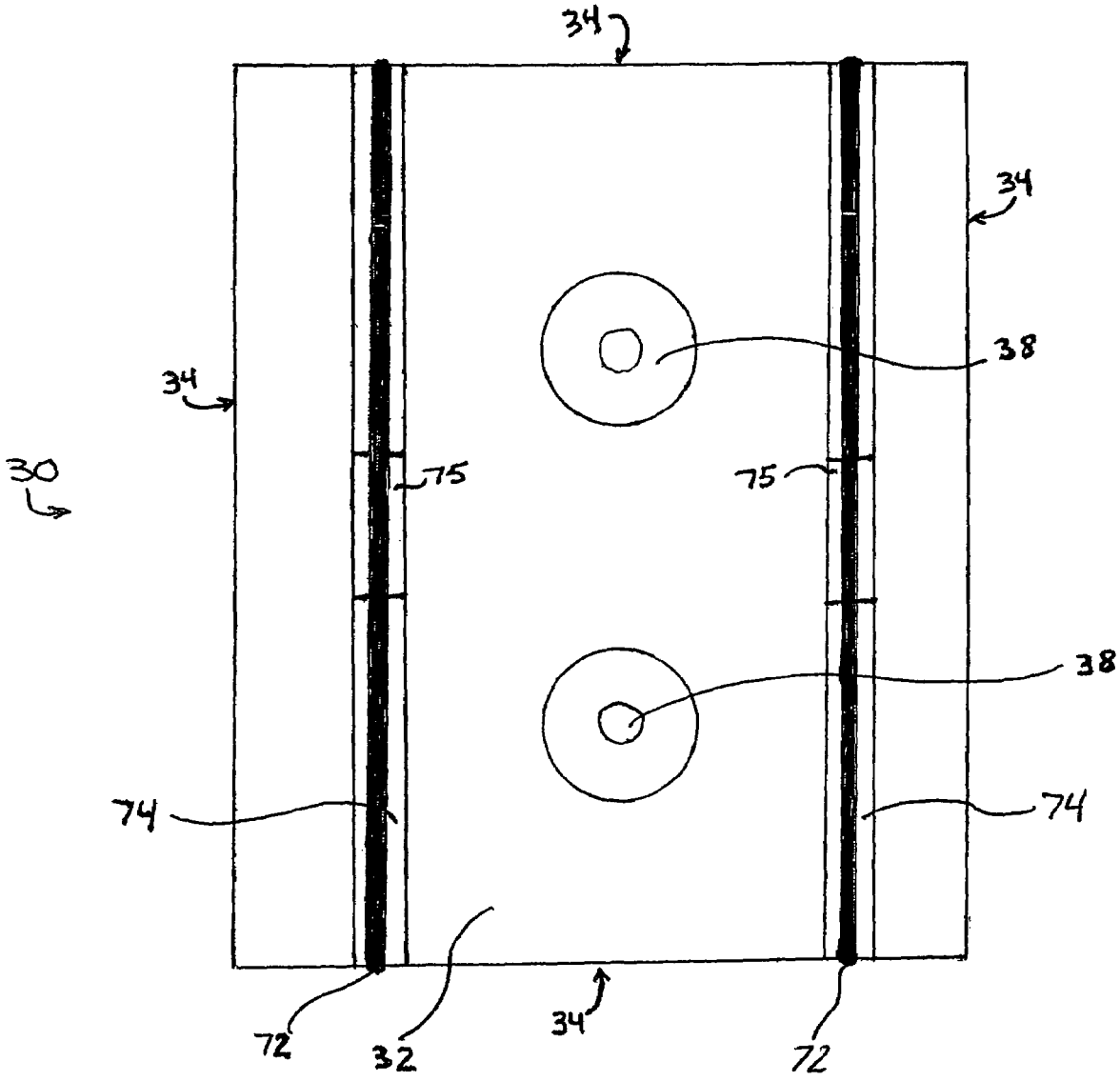
FIG. 2 is a front view of the back member of the embodiment of FIG. 1.

The backing member 30 includes a display surface 32 for the artwork, side edges 34 for engaging the frame member 20, and a rear surface 36 that includes mounting means 38 for attachment to a surface. The mounting means 38 can be any known removable picture mounting means, such as but not limited to sawtooth hangers, braided wire, mounting holes for receiving screws or nails, picture hangers and the like. Preferably, the mounting means is provided as a plurality of mounting holes which protrude through the rear surface 36 to the display surface 32, and are adapted to receive screws or bolts for secure semi-permanent attachment to the mounting surface. As shown in FIG. 2, in this preferred embodiment, the mounting holes include an enlarged recessed portion that enables the user to more easily locate the desired hole location on the mounting surface. The recessed area also ensures a smooth display surface 32 by preventing the screws or picture mounting means from protruding above the display surface 32. Once securely mounted in this manner, the backing member 30 provides a secure and sturdy receiving apparatus for the displayed artwork and for the frame member 20. This mounting assembly avoids unintended displacement from the wall, making it particularly suitable for use by children, elderly adults, and disabled persons. This embodiment of the invention has been found particularly useful for display of school-related artwork and report cards by children, since it allows frequent changing of the artwork without the need for adult assistance.

Figure 3:
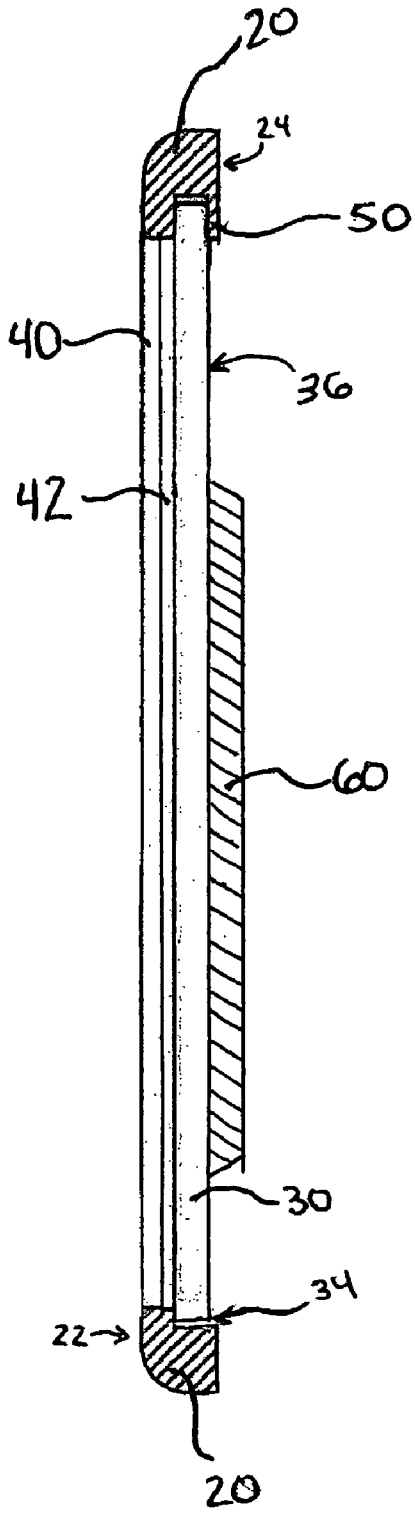
FIG. 3 is a side cross-sectional view of the assembled frame assembly of the embodiment of FIGS. 1 and 2.
Figure 4:
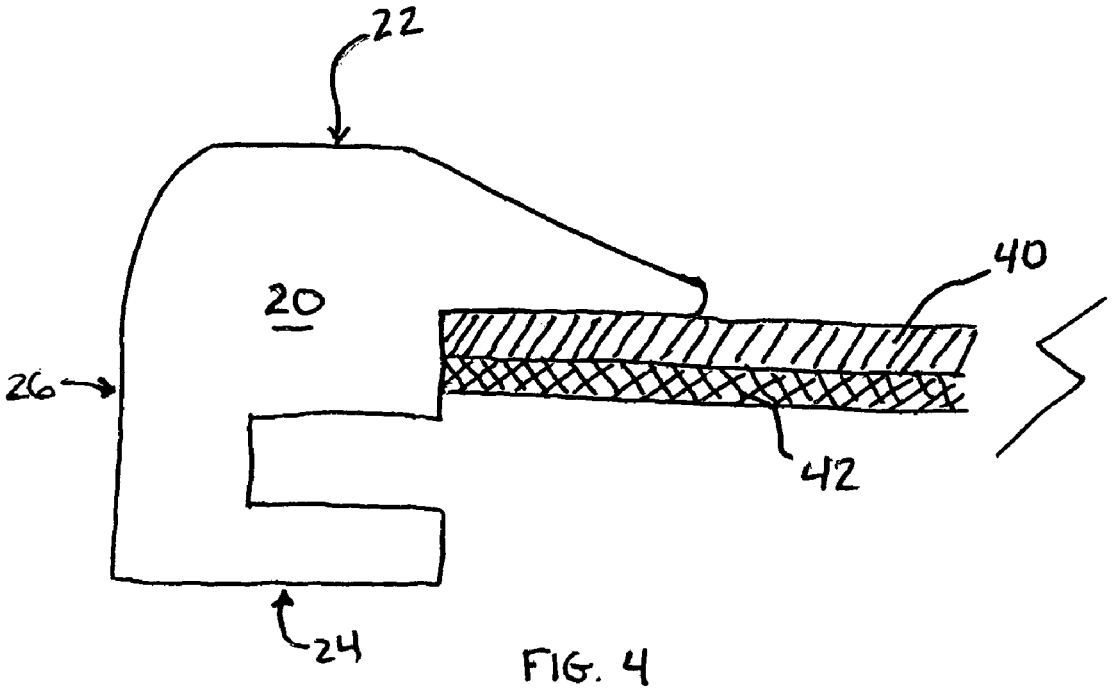
FIG. 4 is a cross sectional view of the preferred embodiment of the attachment means of the present invention.
Figure 5:
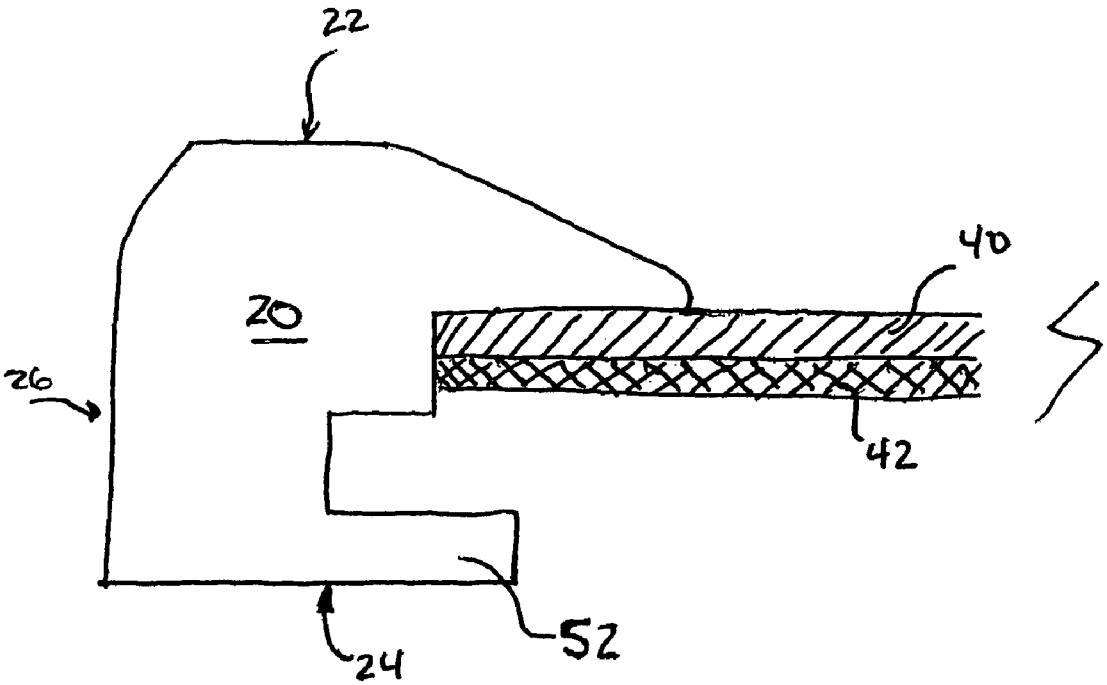
FIG. 5 is a cross sectional view of a second embodiment of the attachment means of the present invention.

The picture frame assembly 10 of the present invention is provided in several embodiments. In the embodiment illustrated in FIGS. 1–3, the picture frame 10 is rectangular and includes a frame member 20 adapted to receive and retain a transparent member, such as by frictional fit, slots, grooves, or other framing means and methods known in the art. In the embodiment of FIGS. 1–3, the frame member 20 has a rear surface 24 with protruding edges 52 provided as attachment means 50 on at least two adjacent sides of the frame member 20. Preferably, the protruding edges 52 are included on the top side of the frame member and on one adjacent side. In this embodiment, the corresponding backing member 30 includes means for spacing the rear surface 36 from the wall or other desired mounting surface. In the embodiment of FIGS. 1–3, the means for spacing is shown as a planar mounting block 60 that also contains the mounting means 38. However, any spacing means can be used in combination with any mounting means 38 known in the art, so long as the side edges 34 of the back member 30 remain sufficiently spaced away from the mounting surface and unobstructed upon mounting of the back member 30 to the wall or other mounting surface. This arrangement allows the frame member 20 to be mounted onto the back member 30 by sliding the protruding edges 52 of the frame member 20 over the side edges 34 or the backing member. This is preferably accomplished by first sliding the protruding edge 52 at the top of the frame member 20 over the top side edge 34 of the backing member 30, then sliding the frame member along the backing member 30 horizontally (i.e in a direction parallel with the top side edge 34) until the adjacent protruding edge 52 engages the side edge 34 of the backing member 30.

The protruding edge attachment means 52 of the embodiment of FIG. 1 can be provided in a number of ways. The protruding edge 52 shown in FIG. 1 and FIG. 3 and FIG. 5 may be formed as an integral feature of the frame, such as during extrusion of an aluminum frame, or may be affixed after forming the frame member 20, such as by affixing a thin longitudinal strip of rigid material to the rear surface 24 by glue, staples, nails, screws, or other attachment means in a manner that leaves a protruding edge 52.

Figure 6:
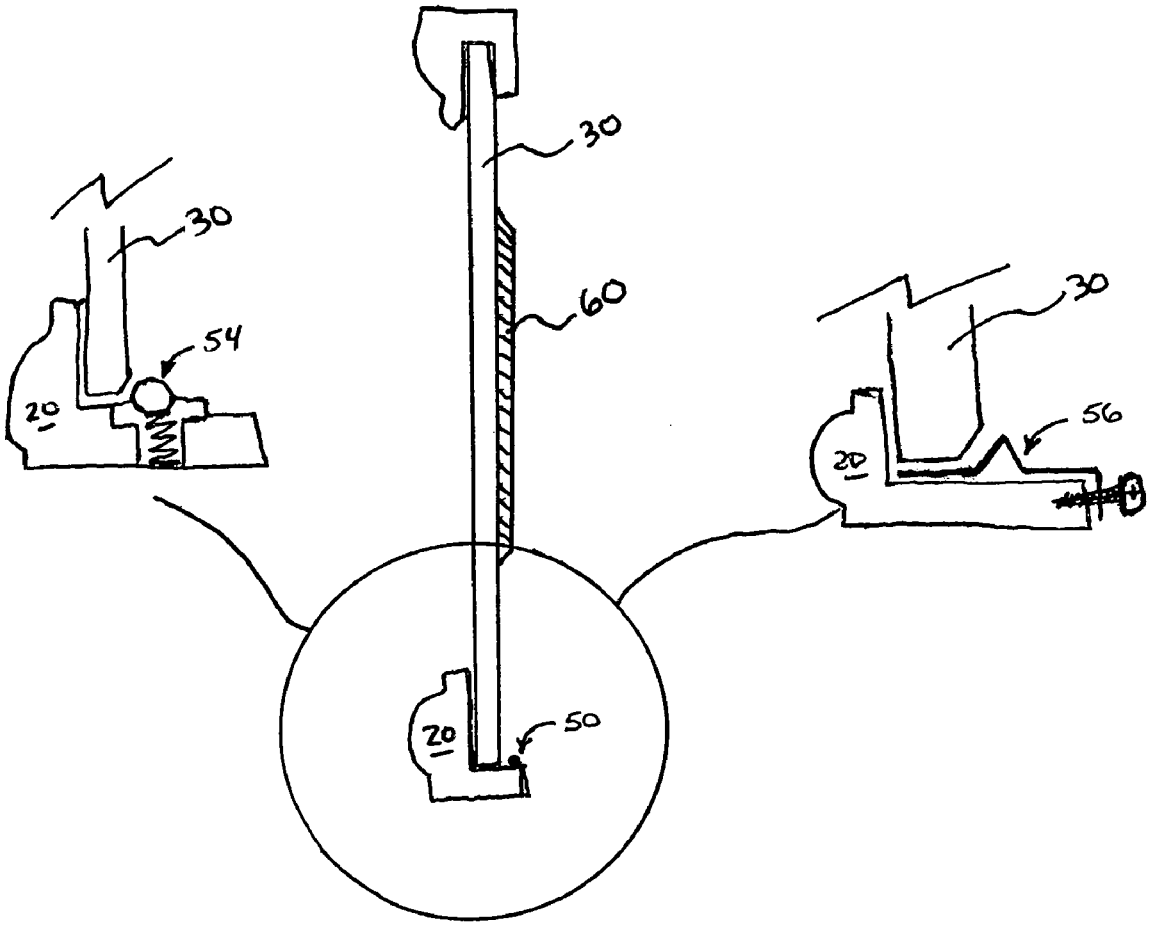
FIGS. 6 and 7 illustrate alternative embodiments of the attachment means of the present invention.
Figure 7:
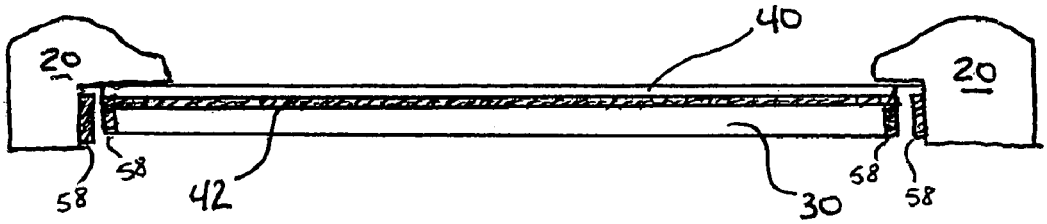

In another embodiment shown in FIG. 6, the attachment means 50 are comprised of at least one spring retainer clip 56 that is preferably affixed to the frame member 20 and disposed so as to engage the side edge 34 or rear surface 36 of the backing member 30. Alternatively, as further shown in FIG. 6, the attachment means 50 may be provided as a spring loaded ball retainer 54 disposed so as to engage the side edge 34 or rear surface 36 of the backing member 30. In yet another embodiment shown in FIG. 7, the attachment means 50 is comprised of opposite pole magnets 58 opposably mounted on the frame member 20 and backing member 30 and adapted so as to removeably engage the frame member 20 and backing member 30. Alternatively, the attachment means may be a combination of at least one magnet 58 located on the frame member 20 and at least one corresponding steel surface provided on the backing member 30. In any embodiment, any combination of different attachment means 50 may be provided to removably engage the frame member 20 and backing member 30 to form a complete frame assembly 10. Additionally, the mounting means 38 used in these alternative embodiments can be selected so as to allow the minimum necessary spacing away from the mounting surface to allow engagement of the frame member 20 and backing member 30.

Another feature of the present invention is a novel artwork retaining means that holds the artwork in place while assembling the frame assembly 10 and during use of the frame assembly 10. As shown in FIG. 2, the artwork retaining means is comprised of at least one elastic member 72. Preferably, the artwork retaining means is comprised of two elastic members 72 in parallel orientation with each other. Preferably, the elastic members 72 are attached to the backing member 30, and are stretched across the artwork display surface 32 of the backing member 30. In the preferred embodiment, the display surface 32 further includes a groove 74 in the surface 32 that runs under each elastic member 72. The groove 74 acts to retain the elastic members in the desired orientation across the display surface 32. The groove 74 may further include a raised portion 75, preferably in the longitudinal center of the groove 74, which allows a user to easily grasp and lift the elastic member 72 from the surface 32, rather than having to pick the elastic member 72 from within the groove 74. Preferably, the elastic members 72 and grooves 74 are spaced sufficiently far apart so as to be hidden from view by matting 42 or by the frame member 20 when the frame assembly 10 is fully assembled. Other artwork retaining means include, but are not limited to tack sheets, tack spray, release tape, and other non-permanent adhesive means.

The present invention further includes methods for displaying artwork. The methods comprise the steps of: determining the desired position of the picture frame on the mounting surface, contacting the back member 30 against the surface in a level position, marking the location of mounting means 38 on the surface through pre-drilled holes in the back member 30, placing a cupped washer or other retainer onto at least one screw, inserting each screw through a pre-drilled hole 38 in the back member 30 and into the surface, and tightening the screws until the backing member 30 or mounting means such as a mounting block 60 is secured against the mounting surface. The method further includes inserting artwork under the elastic bands 72 on the back member 30, and removeably engaging the frame 20 member to the backing member 30 to securely sandwich the artwork into the assembled frame.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A picture frame assembly comprised of:

a frame member having a front surface and a rear surface separated by a perimeter edge, the frame member adapted to receive and retain a transparent member;

a backing member having a display surface and a rear surface separated by a side edge, the rear surface having mounting means for mounting on a mounting surface; and attachment means for removably attaching the front member and the backing member;

wherein the frame member is further comprised of matting;

wherein the attachment means is selected from the group consisting at protruding edges, spring retainers, clips, spring loaded ball devices, magnets, hook and loop fasteners, and combinations thereof;

wherein the backing member further comprises artwork retaining means which is comprised of at least one elastic band;

wherein the display surface further comprises a groove for retaining each said at least one elastic band in a desired orientation; and wherein the groove is further comprised of a raised surface at about the longitudinal center of the groove.

2. A picture frame assembly comprised of:

a frame member having a front surface and a rear surface divided by a perimeter edge, the frame member having a transparent member and matting in contact with the transparent member;

a backing member removably attached to the frame member by attachment means, the backing member having a display surface and a rear surface separated by a side edge, the rear surface having mounting means for mounting on a mounting surface;

wherein the attachment means are selected from the group consisting of protruding edges, spring retainers, clips, spring loaded ball devices, magnets, hook and loop fasteners, and combinations thereof; and artwork retaining means which is comprised of at least one elastic band, and wherein the display surface further comprises a groove for retaining each said at least one elastic band in a desired orientation, wherein the groove is further comprised of a raised surface at about the longitudinal center of the groove.

3. A picture frame assembly comprised of:

a frame member having a front surface and a rear surface divided by a perimeter edge, the frame member having a transparent member and matting in contact with the transparent member;

a backing member removably attached to the frame member by attachment means, the backing member having a display surface and a rear surface separated by a side edge, the rear surface having mounting means for mounting on a mounting surface;

wherein the attachment means are selected from the group consisting of protruding edges, sprig retainers, clips, spring loaded ball devices, magnets, hook and loop fasteners, and combinations thereof; and artwork retaining means which is comprised of at least two elastic bands, and wherein the display surface further comprises at least two parallel grooves, each groove disposed for retaining one of the elastic bands in a desired orientation along the longitudinal center of the groove.

* * * * *

UNITED STATES PATENT AND TRADEMARK OFFICE

CERTIFICATE OF CORRECTION

PATENT NO. : 7,069,682 B2
APPLICATION NO. : 10/670974
DATED : July 4, 2006
INVENTOR(S) : GATT It is certified that error appears in the above-identified patent and that said Letters Patent is hereby corrected as shown below:

Col. 5, Line 53, Claim 1, “consisting at” should be --consisting of--

Signed and Sealed this

Twenty-third Day of January, 2007

JON W. DUDAS
*Director of the United States Patent and Trademark Office*